US006677545B2

(12) United States Patent
Kenmochi

(10) Patent No.: US 6,677,545 B2
(45) Date of Patent: Jan. 13, 2004

(54) ILLUMINATION KEY AND METHOD OF MANUFACTURE

(75) Inventor: Yoshio Kenmochi, Ichihara (JP)

(73) Assignee: Sunarrow Co., Ltd. (JP)

( * ) Notice: Subject to any disclaimer, the term of this patent is extended or adjusted under 35 U.S.C. 154(b) by 173 days.

(21) Appl. No.: 09/854,804

(22) Filed: May 14, 2001

(65) Prior Publication Data

US 2002/0027065 A1 Mar. 7, 2002

Related U.S. Application Data

(60) Continuation-in-part of application No. 09/454,787, filed on Dec. 3, 1999, now abandoned, which is a division of application No. 09/006,763, filed on Jan. 14, 1998, now Pat. No. 6,084,190.

(30) Foreign Application Priority Data

Feb. 18, 1997 (JP) ..... 9-48573
Sep. 29, 1997 (JP) ..... 9-279321

(51) Int. Cl.[7] ..... H01H 9/00
(52) U.S. Cl. ..... 200/314; 200/5 A
(58) Field of Search ..... 200/5 A, 314–345, 200/512–517; 400/472–496; 361/680

(56) References Cited

U.S. PATENT DOCUMENTS 4,463,234 A * 7/1984 Bennewitz ..... 200/5 A
5,234,744 A * 8/1993 Kenmochi ..... 200/310
5,477,024 A * 12/1995 Share et al. ..... 219/121.69
6,023,033 A * 2/2000 Yagi et al. ..... 200/341

FOREIGN PATENT DOCUMENTS

| | | | |
|---|---|---|---|
| EP | 593804 | * | 4/1994 |
| EP | 859388 | * | 8/1998 |
| JP | 5083347 | * | 4/1993 |
| JP | 11027362 | * | 1/1999 |
| JP | 11167835 | * | 6/1999 |

* cited by examiner

*Primary Examiner*—Michael Friedhofer
*Assistant Examiner*—Lisa Klaus
(74) *Attorney, Agent, or Firm*—Hedman & Costigan, P.C.

(57) ABSTRACT

The present invention provides an illumination key and a method of making such illumination key, in which the upper surface of the key top is curved and slanted at an angle to make it possible to reliably recognize the pattern (such as a letter or the like) printed thereon, the key operating portion is provided with a rubber-like click sensitivity and elasticity while the key top portion is made of a hard resin, with the key operating portion and the key to being reliably bonded to each other, and in which a pattern such as a letter or the like can be simply created without the need for laser etching, and wherein it is possible to reliably carry out ON/OFF operations of a one key top without operating neighboring key tops.

6 Claims, 9 Drawing Sheets

(a)

(b)

(a)

(b)

(a)

(b)

(a)

(b)

(a)

(b)

ILLUMINATION KEY AND METHOD OF MANUFACTURE

CROSS REFERENCE TO RELATED APPLICATIONS

The present application is a continuation-in-part of Ser. No. 09/454,787, filed Dec. 3, 1999, now abandoned which is a division of Ser. No. 09/006,763, filed Jan. 14, 1998 now U.S. Pat. No. 6,084,190, which claimed priority from Japanese Applications Serial No. 9-48573, filed Feb. 18, 1997 and Serial No. 9-279321, filed Sep. 29, 1997.

BACKGROUND OF THE INVENTION

1. Field of the Invention

The present invention relates to an illumination key for use in various mobile communication devices, such as cellular phones and automobile phones, and various terminal devices, such as electronic organizers and the like, to enable the keys thereof to be visible in nighttime and low light conditions. The present invention further relates to a method of manufacturing such illumination key.

2. Description of the Prior Art

In the prior art, this type of illumination key is constructed by forming a printed pattern layer, such as a character or the like, into the underside surface of a key top made of light-permeable resin and then fixing a silicon rubber key operating portion to the back side of the printed pattern layer by means of silicon rubber and an adhesive having good adhesive properties.

Further, in the case where a printed pattern layer, such as a character or the like, is formed in the surface of the key top, the etching of the character is carried out with a laser beam, and this makes such prior art illumination keys expensive to manufacture.

Furthermore, because prior art illumination keys are not designated to allow for reduction in size and weight of the key unit when manufacturing thin key tops, it is not possible to meet the market needs for ultralight key tops.

Moreover, because the printed pattern (character) layer is formed in the underside surface of the light-permeable resin key top, the printed pattern (character) is difficult to see in the illumination key described above in the case where the upper surface of the key top has a curved shape.

Furthermore, because the printed pattern (character) is etched by means of a laser beam, it is not possible to prevent high costs when manufacturing such illumination keys.

Moreover, in the case where a printed pattern (characters) is formed on one side of a film which is placed over a plurality of light-permeable resin key tops and heat fused to the upper and side surfaces thereof, because the key tops are connected to each other via the film, misoperations can occur when the operation of one key top also operates a neighboring key top.

Further, when designing a lightweight key top, it is difficult to adequately bond the key top and the key operating portion.

SUMMARY OF THE INVENTION

With a view towards overcoming the problems of the prior art discussed above, it is an object of the present invention to provide an illumination key which makes it possible to reliably recognize a printed pattern (character) even when the upper surface of the key top is slanted or curved, in which a key operating portion is given a rubber-like click sensitivity and a rubber-like elasticity, the key top portion is made from a rigid resin, and a reliably strong bond is created between the key operating portion and the key top.

It is a further object of the present invention to provide an illumination key and a method of manufacturing such illumination key which makes it possible to easily manufacture a printed pattern without laser etching and which makes it possible to reliably carry out ON/OFF operations for one illumination key without affecting (operating) any of the neighboring keys, in which a key operating portion is given a rubber-like click sensitivity and a rubber-like elasticity, the key top portion is made from a rigid resin, and a reliably strong bond is created between the key operating portion and the key top.

Furthermore, it is an object of the present invention to provide an illumination key that can reliably achieve ON/OFF operations while making it possible to reduce the weight of the key top without reducing the bonding strength between the key top and the key operating portion.

In order to achieve these objects, the illumination key according to the present invention is constructed from a key top made of light-permeable resin; a film having a printed pattern (character) formed in the upper or the bottom surface of the film, the film being fixed to the top and side surfaces of the key top and cut away form the lower periphery of the side surfaces of the key top; a light-permeable keypad having an operating portion and a non-operating portion, while the non-operating portion is connected to the operating portion through a thin portion; and a key operating portion made of light-permeable silicon rubber or thermoplastic elastomer which is fixed to the underside surface of the key top by means of a transparent adhesive.

In this structure, the film has thickness of 100 um–200 um, with the printed pattern being provided on either the top or bottom surface of the film.

Further, in the method of manufacturing the illumination key according to the present invention, a film having a printed pattern (character) formed in one side thereof is set inside a metal mold, and then injection molding is carried out by injecting a light-permeable resin into the cavity to form a key top, whereby the film formed with the printed pattern layer is heat fused to the upper surface of the key top. Next, after a jig is used to cut away the film from the lower periphery of the key top, a transparent adhesive is used to fix the underside surface of the key top to the upper surface of a key operating portion made from a light-permeable silicon rubber or thermoplastic elastomer.

Further, in the illumination key to the present invention, it is possible to form a partial transmission type light reflection membrane having a white color or the like on all surfaces excluding the underside surface of the light-permeable resin key top, with the printed pattern (character) layer being formed in the upper surface of such a partial transmission type reflection membrane. In this case, except for the printed pattern (character) portion, an opaque layer is provided to cover the upper and side surfaces of the key top, with the upper and side surfaces of the opaque layer being covered by a transparent protection layer. And as before, a transparent adhesive is used to fix the underside surface of the key top to the upper surface of a key operating portion made of light-permeable silicon rubber or thermoplastic elastomer.

Further, in the illumination key according to the present invention, it is possible to use a thin key top made from a white-colored or a colored partial light-permeable resin, with the printed pattern (character) being formed on a surface of the key top which excludes the underside thereof. And as before, a transparent adhesive is used to fix the underside surface of the key top to the upper surface of a key operating portion made of light-permeable silicon rubber or thermoplastic elastomer.

In the illumination key according to the present invention, an operating shaft is formed at a central portion of the underside of a transparent resin key top mounted and bonded on top of a key operating portion formed from a transparent rubber or thermoplastic elastomer, and a cavity portion is formed in the underside of the key tops in order to make the key top thinner.

Further, the transparent resin key top formed with the operating shaft is formed from a hard foaming resin such as polyurethane foam or the like.

Furthermore, the lower portion of the operating shaft of the transparent resin key top is fitted into a concave portion formed in a central upper surface portion of the transparent rubber or thermoplastic elastomer key operating portion, with such fitting portion being bonded by a transparent adhesive.

Further, in the illumination key according to the present invention, a protruding portion is formed at the central upper surface portion of the transparent rubber or thermoplastic elastomer key operating portion, and also formed in such central portion is an insertion hole into which is fitted the operating shaft of the transparent resin key top, with such fitting portion being bonded by a transparent adhesive.

Further, in the illumination key according to the present invention, an annular erect flange is formed near the outer periphery of the upper surface of the transparent rubber or thermoplastic elastomer key operating portion, and the outer circumferential surface of the annular erect flange is bonded by means of an adhesive to a contact surface of the outer peripheral surface of the inside of the cavity portion of the transparent resin key top.

BRIEF DESCRIPTION OF THE DRAWINGS

FIG. 4(*b*) is a cross-sectional schematic view of another embodiment of the present invention.

FIG. 8(*b*) is a schematic cross-sectional view of a weight-reducing structure according to another embodiment of the present invention.

FIG. 9(*b*) is a schematic cross-sectional view of a weight-reducing structure according to another embodiment of the present invention.

FIG. 10(*b*) is a schematic cross-sectional view of a weight-reducing structure according to another embodiment of the present invention.

FIG. 11(*b*) is a schematic cross-sectional view of a weight-reducing structure according to another embodiment of the present invention.

DETAILED DESCRIPTION OF THE PREFERRED EMBODIMENTS

A detailed description of a preferred embodiment of the present invention will now be given below.

Figure 1:
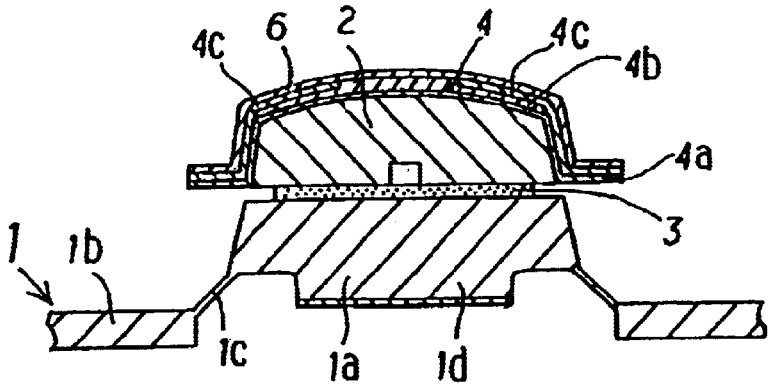
FIG. 1 is a cross-sectional schematic view of one embodiment of the present invention.
Figure 2:
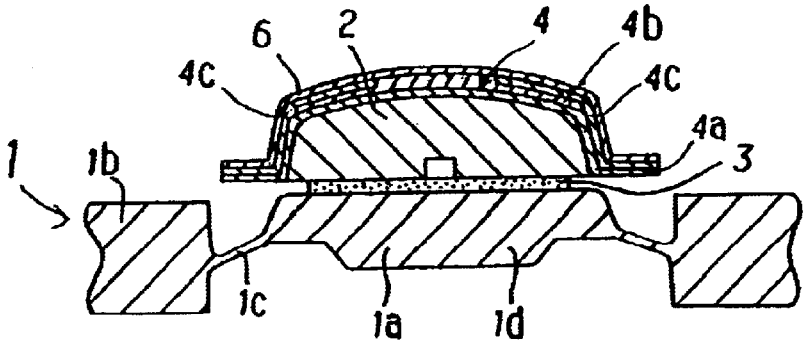
FIG. 2 is a cross-sectional schematic view of another embodiment of the present invention.
Figure 4:
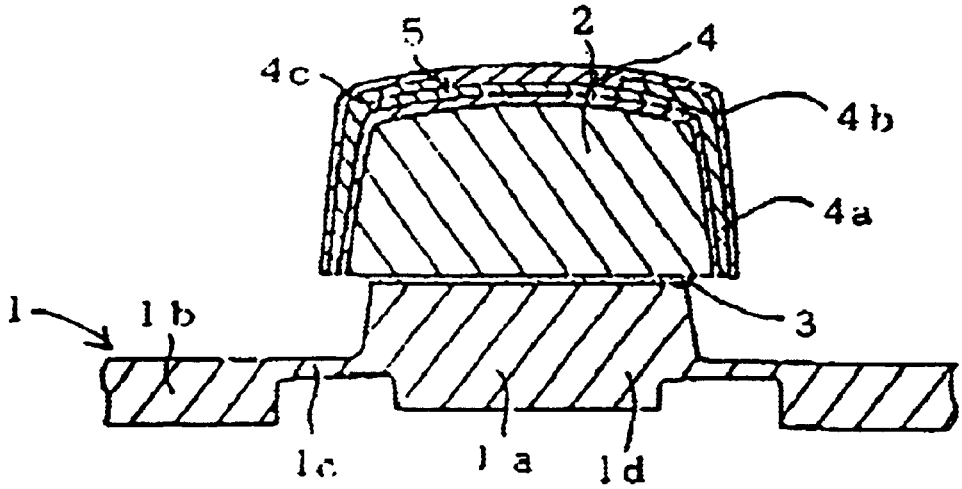
FIG. 4(*a*) is a cross-sectional schematic view of another embodiment of the present invention.
Figure 4:
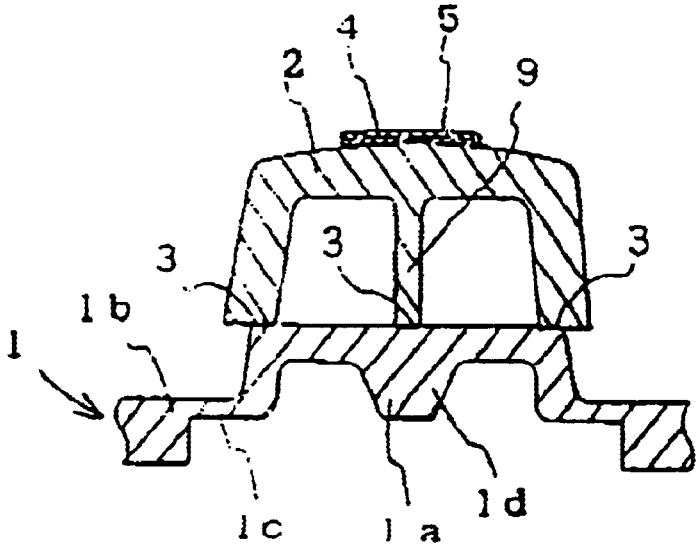
Figure 5:
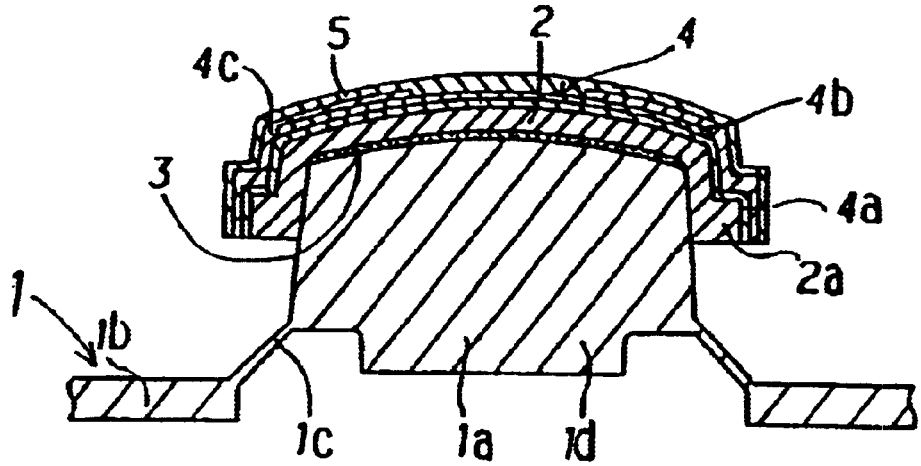
FIG. 5 is a cross-sectional schematic view of another embodiment of the present invention.
Figure 6:
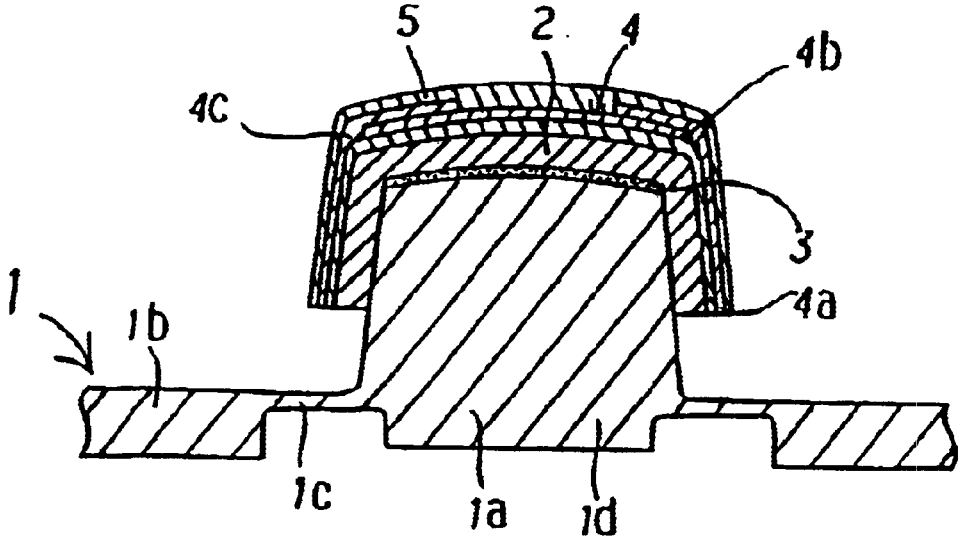
FIG. 6 is a cross-sectional schematic view of another embodiment of the present invention.

As shown in the drawings, a light-permeable key pad 1 has an operating portion 1*a* and a non-operating portion 1*b* connected to the operating portion 1*a* through a thin portion formed as an integral body from transparent silicon rubber, other transparent rubber or transparent thermoplastic elastomer such as vinyl chloride based elastomer, polyolefin base elastomer, polysterene-polybutadiene copolymer thermoplastic elastomer, ethylene vinyl acetate elastomer, chlorinated polyethylene elastomer, polyurethane rubber or the like. By forming the keypad 1 from rubber or a thermoplastic elastomer, it is possible to utilize the rubber-like characteristics to obtain click-sensitivity and rapid operation sensitivity with the operating portion 1*a*. Further, in addition to the case shown in FIG. 1, in which the operating portion 1*a* is formed from a thin skirt portion 1*c*, in which the operating portion 1*a* is formed from a thin skirt portion 1*c*, which rises up along a slant from the lower portion of the side surface of the non-operating portion 1*b*, and a key top support portion 1*d* which is integrally supported at the upper portion of the skirt portion 1*c*, it is possible to construct the operating portion 1*a* as shown in FIG. 2, in which forms the erect thin skirt portion 1*b* toward the upper slanting portion thereof, or, as shown in FIG. 4, the slanting skirt portion is eliminated and the key top supporting portion 1*d* extends out horizontally from a thick side surface of the non-operating portion 1*b*. In this connection, it should be noted that the present invention is not limited to these structures, and it is possible to utilize any other structure so long as it is possible to support a key top 2. In the case where a skirt portion 1*c* is provided, this skirt portion 1*c* carries out a click action.

Further, the operating portion 1*a* is arranged above a substrate (not shown in the drawings) at a position corresponding to a fixed contact point on the substrate, with a rubber click structure being created by forming an electrically conductive contact member on the underside of the operating portion 1*a*, or with a dome click structure being created by means of a dome switch such as a metal dome switch (not shown in the drawings).

Figure 3:
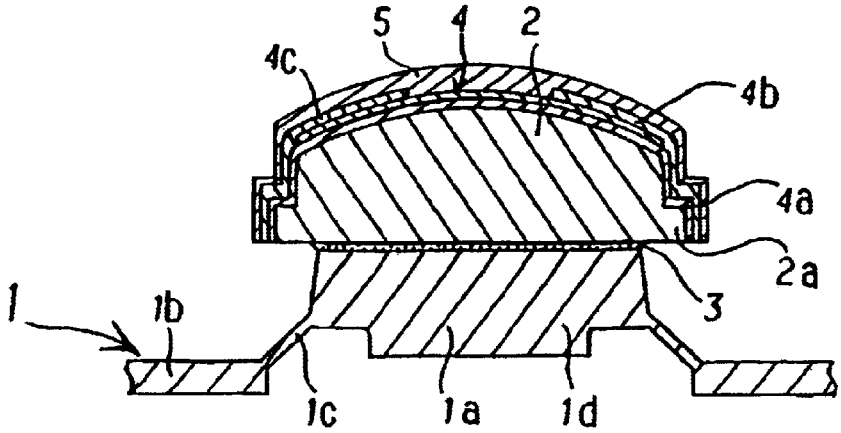
FIG. 3 is a cross-sectional schematic view of another embodiment of the present invention.

The key top 2, made from a thermoplastic resin such as ABS, polycarbonate, acrylic resin or the like, is fixedly mounted to the top of the key top support portion 1*d* by means of a transparent adhesive 3. In this connection, the upper surface of the key top 2 may have any of a variety of shapes, such as a curved shape which slants in one direction, for example. Further, the lower portion of the key top 2 may be formed to include a brim portion 2*a*, as shown in FIG. 3, or lower portion of the key top 2 may be formed without such a brim portion. In general, to enable light to pass through the key top 2, a transparent or translucent material around 1 mm thick (e.g., in the range 0.8 mm–1.5 mm) is used to make the key top 2, and in this regard it is possible to use a white-colored material which allows light at a certain intensity to pass therethrough. In the case where the key top 2 is formed from such partially light-permeable white-colored material, there is no need to form the partial transmission light reflecting membrane 4*a* described below.

The transparent adhesive 3 is an adhesive used to bond the key top 2, made of a thermoplastic resin such as ABS, polycarbonate, acrylic resin or the like, with the key pad 1, made of a silicon rubber or other rubber material or thermoplastic elastomer, which is an integral body formed from the operating portion 1*a* and the non-operating portion 1*b*. In this connection, the adhesive 3 may be any adhesive which makes it possible to bind two different materials together; for example, it is possible to use a silicon type transparent adhesive in this case of silicon rubber.

Further, with the exception of the underside surface, a printed pattern (character) layer 4 is formed in the surface of the key top using any of the methods described below.

In one method, a partial transmission light reflecting membrane 4*a* having a bright color to reflect white light and the like is formed on all surfaces the light permeable resin key top 2 except for the underside surface thereof. For example, it is possible to use a white coating as the partial transmission light reflecting membrane. Next, a solid chromatic color printing is carried out in red, blue, yellow or the like to form a pattern comprised of a letters, symbols, figures or the like, with all of the solid printing 4*b* except for the portion containing the pattern being covered by a black opaque membrane 4*c*. Further, the opaque membrane 4*c* and the portion of the solid printing 4*b* which contains the pattern (character or the like) is covered by a transparent protective membrane 5 formed from a transparent resin such as urethane or the like.

The printed pattern layer 4 may be formed to have either a positive condition, in which only the etched character (pattern) portion is printed in a chromatic color, or a negative condition in which all of the printed pattern layer 4 except for the etched character (pattern) is colored.

Further, as shown in FIG. 4(*b*), it is possible to form a printed pattern layer 4 such as letters or the like on the surface of the thin white or colored translucent resin key top without forming the partial transmission light reflecting layer 4*a* and the opaque layer 4*c*. However, in the case of FIG. 4(*b*), it is possible to form a protection layer to protect the printed pattern layer 4 as the need arises.

Figure 7:
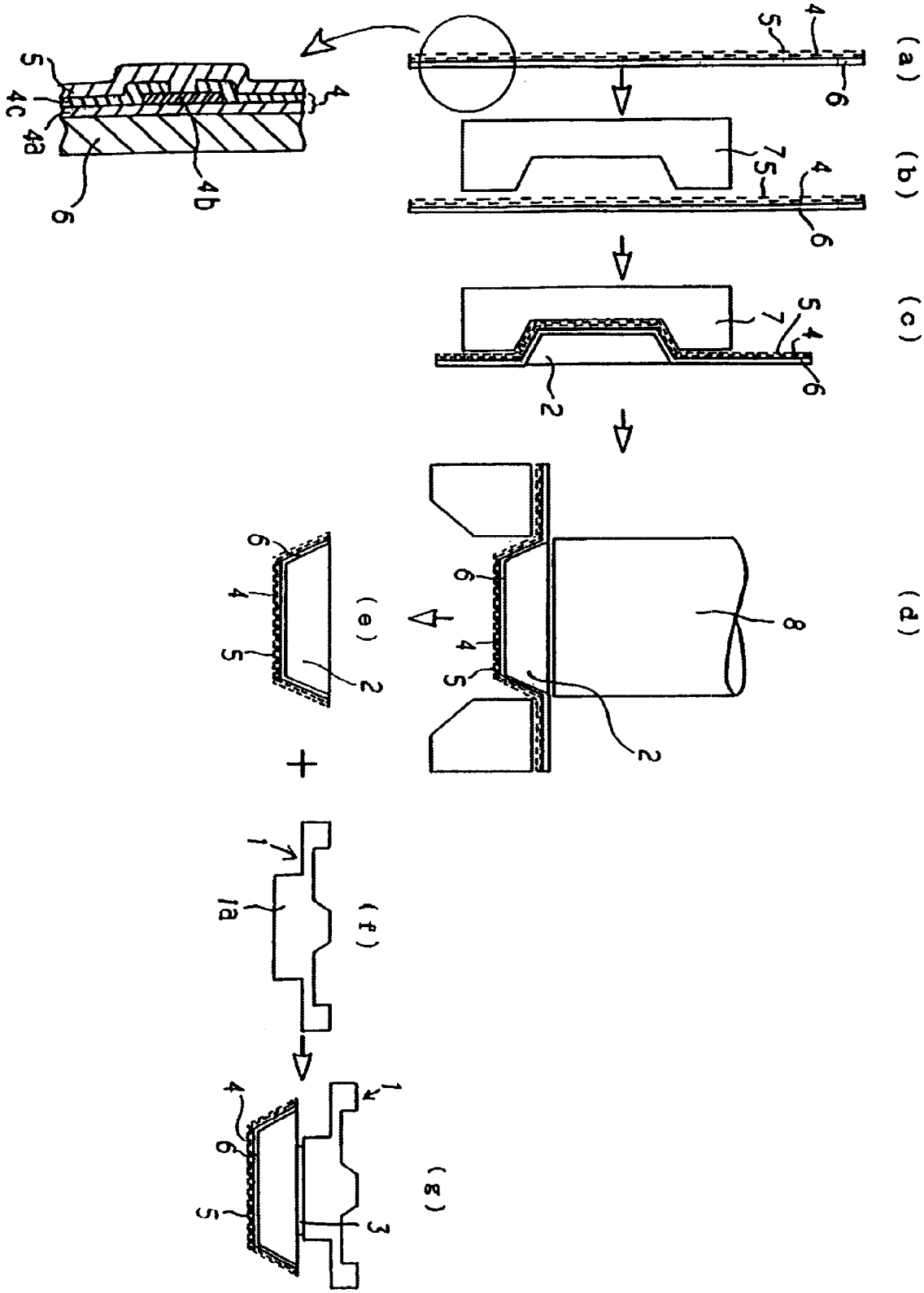
FIGS. 7(*a*)–(*g*) are explanatory schematic views showing the process of the method of manufacturing the illumination key according to the present invention.
Figure 8:
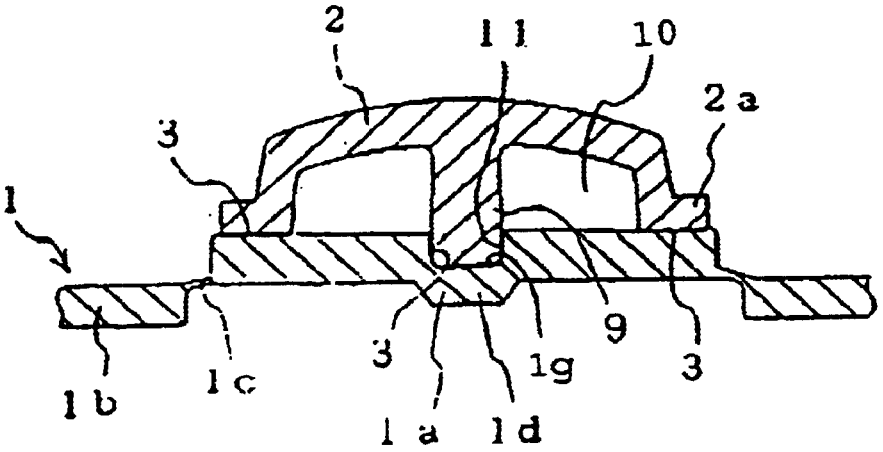
FIG. 8(*a*) is a schematic cross-sectional view of a weight-reducing structure according to one embodiment of the present invention.
Figure 8:
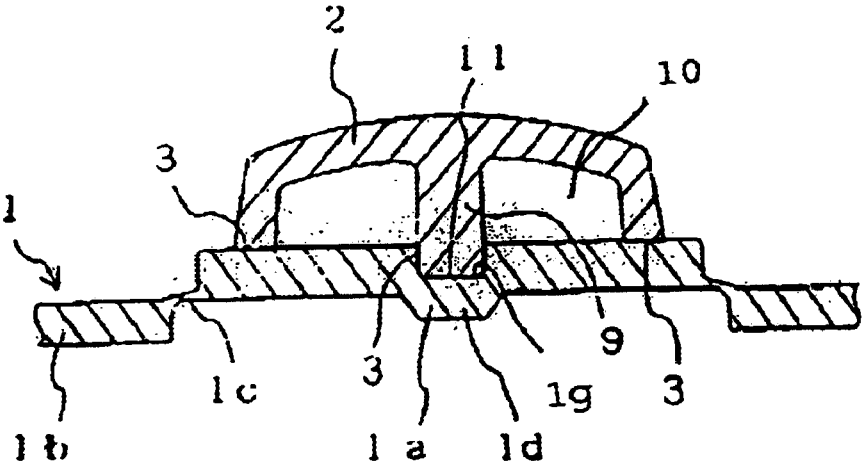
Figure 9:
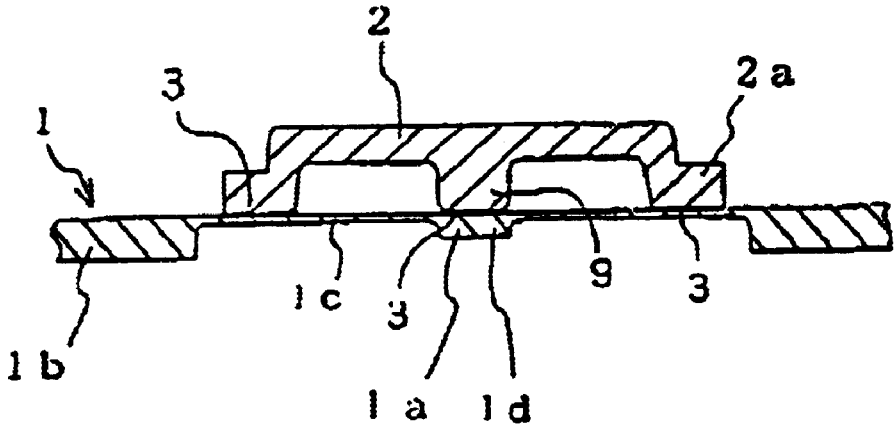
FIG. 9(*a*) is a schematic cross-sectional view of a weight-reducing structure according to another embodiment of the present invention.
Figure 9:
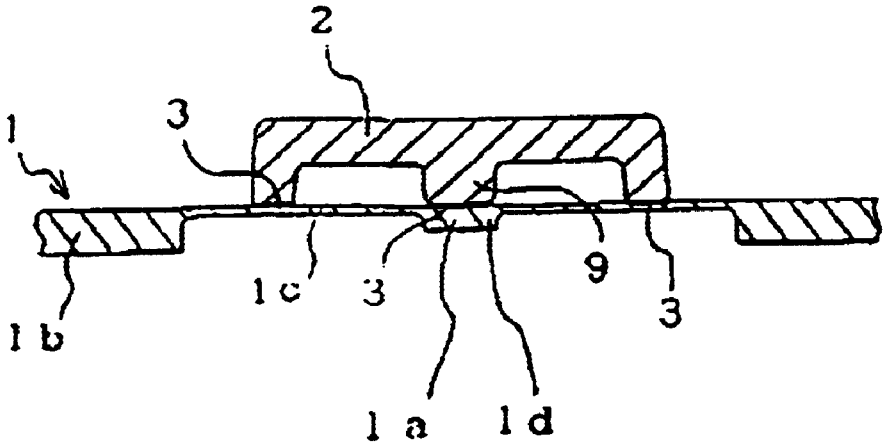

Another way of forming a printed pattern (character) layer 4 on a surface of the resin key top 2 which excludes the underside there of is shown in FIGS. 7(*a*)–(*g*). In this method, a 100 um–200 um thick film 6 made of a transparent synthetic resin such as polycarbonate or the like and having a printed pattern (character) preformed in one side thereof is set inside a metal resin forming mold 7, and then injection molding is carried out by injecting a resin into the cavity to form the key top 2, whereby the film 6 formed with the printed pattern layer 4 is heat fused to the surface of the key top 2.

In this connection, it is to be noted that the printed pattern surface may be formed on either the upper or lower surface of the film 6. In the case where the printed surface is formed on the upper surface of the film 6, a protection layer 5 formed, for example, from a clear urethane coating is provided on top of the printed pattern surface. Further, it is necessary to set the thickness of the film 6 at 100 $\mu$m–200 $\mu$m to give the film 6 sufficient strength when undergoing operations inside the metal mold 7.

Next, a jig 8 is used to cut away the film 6 from the lower periphery of the key top 2. In this way, by using the jig 8 to cut away the film 6 from the lower periphery of the key top 2, when one key top 2 is pressed, such action does not operate neighboring key tops, and this makes it possible to reliably carry out ON/OFF operations for a particular key top 2.

Next, the underside surface of the key top 2 is fixed by means of a transparent adhesive 3 to the upper surface of a key operating portion 1*a* made from a light-permeable silicon rubber.

Further, in the case where the body of the resin key top 2 is formed to have a thickness around 1 mm, it is possible to use the above method to form a printed pattern (character) layer 4 without having to apply a white-colored coating to the surface of the key top 2 so long as it is possible for the body of the key top 2 to reflect white light and the like and at the same time allow light at a certain intensity to pass therethrough.

Then, after forming the printed pattern layer 4 in the upper surface of the key top 2, the underside surface of the key top 2 is fixed to the upper surface of a key operating portion 1*a* of a key pad 1 by means of the transparent adhesive 3.

Next, the means for making the illumination key ultralight will be described.

As is structurally shown in FIGS. 8–11, an operating shaft 9 is integrally formed at a central portion of the underside of the transparent key top 2 which is mounted and bonded to the top of the transparent rubber or thermoplastic elastomer key operating portion 1*b*. Further, a cavity 10 for making a thin key top 2 is carved out to form a circular space to receive the operating shaft 9 of the underside of the key top 2. Further, the thickness of the underside of the key top 2 should have roughly the same thickness structure. The material used for the key top 2 should be chosen so as to prevent the key top 2 from being indented when the key top 2 is struck by a finger. Of course, the contact surfaces of the key top 2 and the key operating portion 1*a* are fixed by means of a transparent adhesive.

By forming the operating shaft 9 on the underside of the key top 2, it is possible to guarantee reliable ON/OFF operations of the key operating portion 1*b* when the key top 2 is pressed with a finger or the like.

Figure 10:
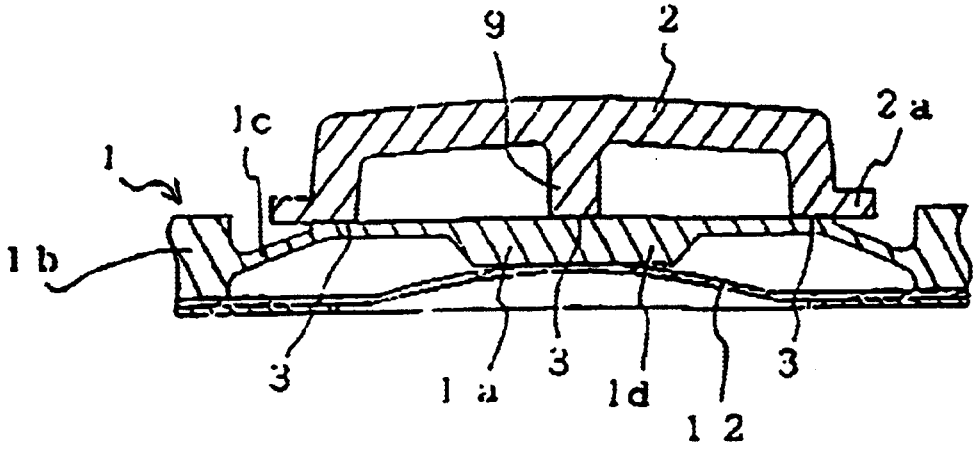
FIG. 10(*a*) is a schematic cross-sectional view of a weight-reducing structure according to another embodiment of the present invention.
Figure 10:
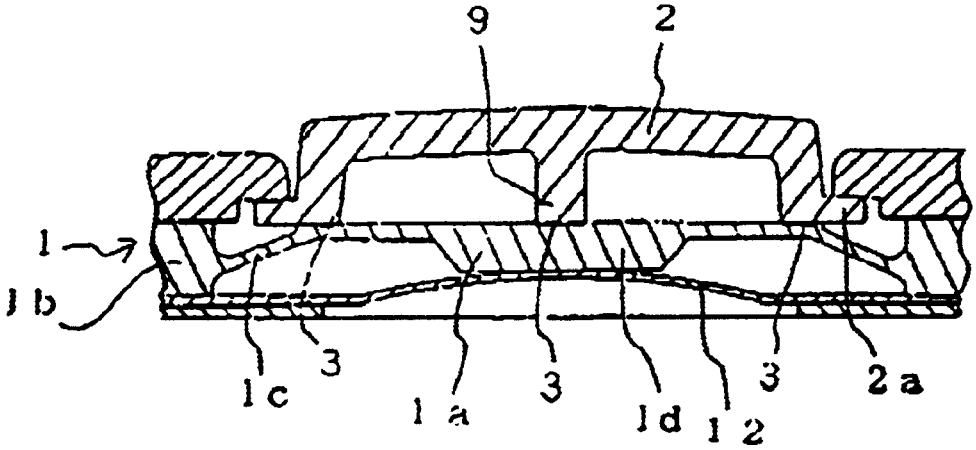

When selecting a material for the key top 2, in order to achieve an even higher reduction in weight, the transparent resin key top 2 shown in FIG. 10 should preferably be formed from a hard foaming resin such as polyurethane foam or the like.

In order to vastly improve the bonding strength when fixing the contact surfaces of the key top 2 and the key operating portion 1*a* by means of a transparent adhesive 3, the lower portion of the operating shaft 9 of the transparent resin key top 2 is fitted into the concave portion 1*g* formed in the central upper portion of the transparent rubber or thermoplastic elastomer key operating portion 1*a*. In this way, because a vertical bonding is carried out on the fitting portion 11 of the lower portion of the operating shaft 9 fitted into the concave portion 1*g*, it is possible to achieve an increase in bonding strength several times higher compared to horizontal bonding.

Figure 11:
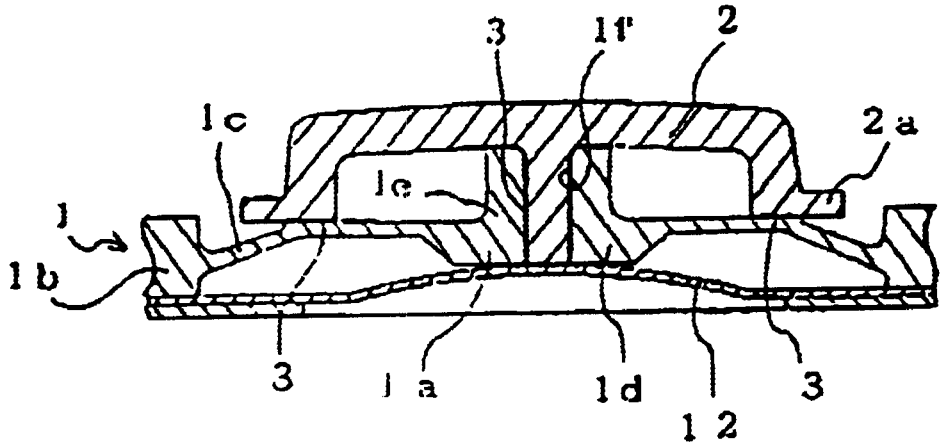
FIG. 11(*a*) is a schematic cross-sectional view of a weight-reducing structure according to another embodiment of the present invention.
Figure 11:
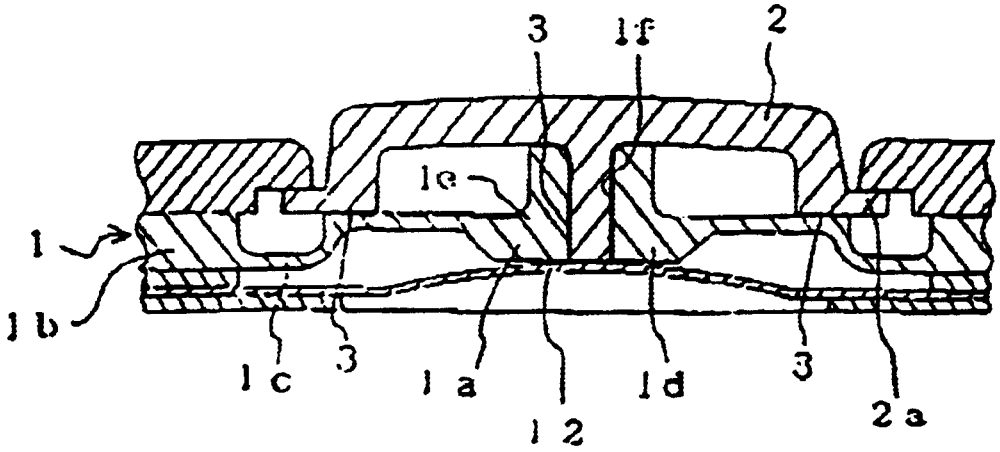

To further increase the bonding strength, a protruding portion 1*e* as shown in FIG. 11 is formed on a central portion of the upper surface of the transparent rubber or thermoplastic elastomer key operating portion 1*b*, and an insertion hole 1*f* is formed in the central portion of the protruding portion 1*e* into which the operating shaft 9 of the transparent resin key top 2 fitted and vertically bonded by the application of a transparent adhesive.

In FIG. 11, the number 12 indicates a PET or a metal dome switch.

Figure 12:
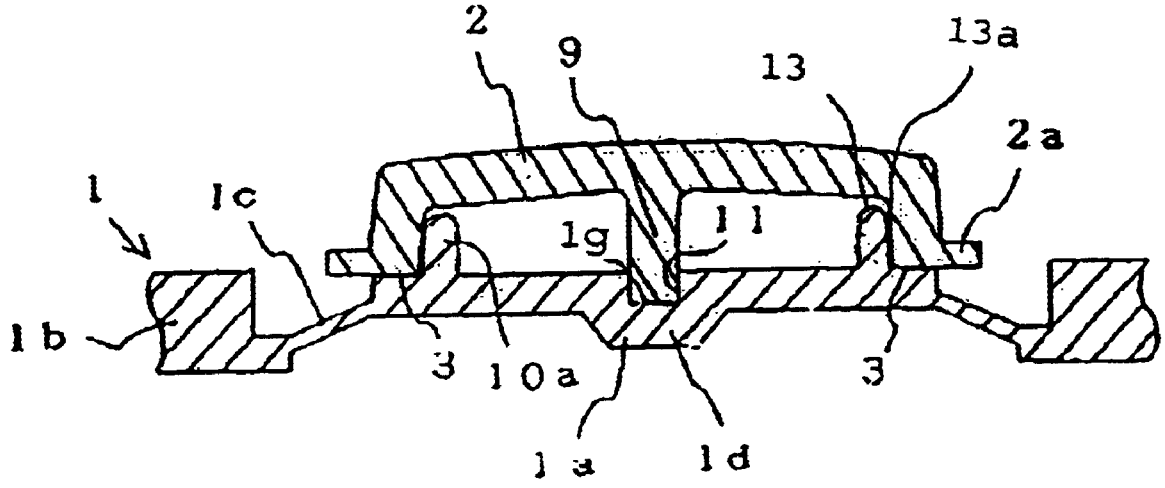
FIG. 12 is a schematic cross-sectional view of a weight-reducing structure according to another embodiment of the present invention.

Further, as shown in FIG. 12, an annular erect flange 13 is formed near the outer periphery of the upper surface of the transparent rubber or thermoplastic elastomer key operating portion 1*b,* and the outer circumferential surface of the annular erect flange 13 is bonded by means of an adhesive to a contact surface of the outer peripheral surface 10*a* of the inside of the cavity portion 10 of the transparent resin key top 2, whereby it becomes possible to maintain a sufficient bonding strength while at the same time achieving a reduction in weight. Further, it is possible to use or not use an adhesive when fitting the lower portion of the operating shaft 9 into the concave portion 1*g* of the central portion of the upper surface of the transparent rubber or thermoplastic elastomer key operating portion 1*b*.

Now, by having the structure described above, the illumination key according to the present invention makes it possible to reliably recognize the character (pattern) on the key top 2 even when the upper surface of the key top 2 has a curved or slanting shape. Furthermore, because the key operating portion creates a rubber-like click sensitivity and a rubber-like elasticity while the resin of the key top portion is made rigid, and because it is possible to reliably achieve a strong bond between the key operating portion and the key top, the illumination key according to the present invention makes it possible to reliably carry out key operations by preventing misoperations and other problems such as peeling or the like.

Furthermore, in the method of manufacturing an illumination key according to the present invention, the use of a laser is done away with and the printed pattern (character) layer is easily formed using printing technology. Moreover, because the film of one key top is separate from the film of the other key tops, the operation of one key top does not affect (operate) any of the neighboring key tops, and this makes it possible to reliably carry out ON/OFF operations for any key top.

Consequently, the present invention makes it possible to easily and cheaply provide an illumination key and a method of manufacturing such illumination key, in which a key operating portion is given a rubber-like click sensitivity and a rubber-like elasticity, the key top portion is made from a rigid resin, and a reliably strong bond is created between the key operating portion and the key top.

In particular, the structure described above makes the illumination key according to the present invention suitable for use in thin-type devices such as cellular phones and the like.

Further, because the lower portion of the operating shaft of the key top is fitted into the concave portion formed in the central portion of the upper surface of the key operating portion when the contact surfaces of the key top and key operating portion are bonded together, it is possible to carry out a vertical bonding, and this makes it possible to improve the bonding strength by several times in addition to that achieved by horizontal bonding, whereby it becomes possible to increase the bonding strength for a small amount of contact surface. Furthermore, by forming a protruding portion on the central portion of the upper surface of the key operating portion, and by fitting and bonding the operating shaft of the key top into the insertion hole of such protruding portion, it is possible to achieve an even higher effective bonding.

Further, in the present invention, by forming an operating shaft at the central portion of the underside of the key top and a cavity around the periphery of such operating shaft, it becomes possible to make a thin key top, whereby it becomes possible to reduce the entire weight of the key. Furthermore, by forming the key top from a hard foaming resin, it is possible to achieve an even higher reduction in weight while preventing the key top from being indented when struck.

Furthermore, an annular erect flange is formed near the outer periphery of the upper surface of the transparent rubber or thermoplastic elastomer key operating portion, and the outer circumferential surface of the annular erect flange is bonded by means of an adhesive to a contact surface of the outer peripheral surface of the inside of the cavity portion of the transparent resin key top described in claim 7, whereby it becomes possible to maintain a sufficient bonding strength while at the same time achieving a reduction in weight.

Finally, it is to be understood that many changes and additions may be made to the embodiments described above without departing from the scope and spirit of the invention as defined in the appended Claims.

What is claimed is:

1. An illumination key, comprising:

a light-permeable resin key top:

a film having a pattern formed in one side thereof, the film being fixed to upper and side surfaces of the light permeable resin key top;

a light-permeable keypad having an operating portion and a non-operating portion, while the non-operating portion is connected to the operating portion through a thin portion; and an upper surface of a key operating portion made from transparent rubber or thermoplastic elastomer, being fixed to an underside surface of said key top by means of a transparent adhesive.

2. An illumination key, comprising:

a partial transmission type light reflecting membrane formed on upper and side surfaces of a light permeable resin key top excluding an underside surface of said key top;

a pattern formed on upper and side surfaces of the partial transmission type light reflecting membrane;

an opaque layer covering the upper and side surfaces of said key top excluding the pattern;

a transparent protection layer formed on upper and side surfaces of the opaque layer;

a light-permeable keypad having an operating portion and a non-operating portion, while the non-operating portion is connected to the operating portion through a thin portion; and an upper surface of said key operating portion made from a transparent rubber or thermoplastic elastomer being fixed to the underside surface of said key top by means of a transparent adhesive.

3. An illumination key, comprising:

a relatively thin key top made of white-colored resin key top;

a pattern formed on upper and side surfaces of said key top excluding an underside surface of the key top;

an opaque layer covering the upper and side surfaces of said key top excluding the pattern;

a transparent protection layer formed on upper and side surfaces of said opaque layer;

a light-permeable keypad having an operating portion and a non-operating portion, while the non-operating portion is connected to the operating portion through a thin portion; and an upper surface of said operating portion made from a transparent rubber or thermoplastic elastomer being fixed to the underside surface of said key top by means of a transparent adhesive.

4. An illumination key, which consists essentially of:

a light-permeable resin key top:

a film having a pattern formed in one side thereof, the film being fixed to upper and side surfaces of a light permeable resin key top;

a light-permeable keypad having an operating portion and a non-operating portion, while the non-operating portion is connected to the operating portion through a thin portion; and an upper surface of a key operating portion made from transparent rubber or thermoplastic elastomer, being fixed to an underside surface of said key top by means of a transparent adhesive.

5. An illumination key, which consist essentially of:

a partial transmission type light reflecting membrane formed on upper and side surfaces of a light permeable resin key top excluding an underside surface of said key top;

a pattern formed on the upper surfaces of the partial transmission type light reflecting membrane;

an opaque layer covering the upper and side surfaces of said key top excluding the pattern formed portion;

a transparent protection layer formed on upper and side surfaces of the opaque layer;

a light-permeable keypad having an operating portion and a non-operating portion, while the non-operating portion is connected to the operating portion through a thin portion; and an upper surface of said key operating portion made from a transparent rubber or thermoplastic elastomer being fixed to the underside surface of said key top by means of a transparent adhesive.

6. An illumination key, which consist essentially of:

a relatively thin key top made of a white-colored resin key top;

a pattern foamed on upper and side surfaces of said key top excluding an underside surface of the key top;

an opaque layer covering the upper and side surfaces of said key top excluding the pattern formed portion;

a transparent protection layer formed on upper and side surfaces of said opaque layer;

a light-permeable keypad having an operating portion and a non-operating portion, while the non-operating portion is connected to the operating portion through a thin portion; and an upper surface of said operating portion made from a transparent rubber or thermoplastic elastomer being fixed to the underside surface of said key top by means of a transparent adhesive.

* * * * *